US007219662B1

(12) United States Patent
Henry

(10) Patent No.: US 7,219,662 B1
(45) Date of Patent: May 22, 2007

(54) DROP REST ASSEMBLY FOR AN ARCHERY BOW

(76) Inventor: Donald J. Henry, Box 28, Route 220, New Albany, PA (US) 18833

( * ) Notice: Subject to any disclaimer, the term of this patent is extended or adjusted under 35 U.S.C. 154(b) by 61 days.

(21) Appl. No.: 10/906,172

(22) Filed: Feb. 5, 2005

Related U.S. Application Data

(60) Provisional application No. 60/521,019, filed on Feb. 6, 2004.

(51) Int. Cl.
*F41B 5/22* (2006.01)

(52) U.S. Cl. ..... 124/44.5

(58) Field of Classification Search ..... 124/24.1, 124/44.5

See application file for complete search history.

(56) References Cited

U.S. PATENT DOCUMENTS 5,421,314 A * 6/1995 Kidney ..... 124/44.5
6,044,832 A * 4/2000 Piersons, Jr. ..... 124/44.5
6,202,635 B1 * 3/2001 Evans ..... 124/44.5
6,913,008 B2 * 7/2005 Simo et al. ..... 124/44.5

* cited by examiner

*Primary Examiner*—John A. Ricci
(74) *Attorney, Agent, or Firm*—John J. Elnitski, Jr.

(57) ABSTRACT

A drop rest assembly, for an archery bow that allows for resting of arrow which is to be fired by the archery bow. The drop rest assembly includes a mounting section adapted to mount to the archery bow. The drop rest assembly includes a drop rest section mounted to the mounting section. The drop rest section includes a drop rest mount which mounts to the mounting section. The drop rest section includes an arrow rest rotatably mounted to the drop rest mount, where the arrow rest mechanically biased away from an arrow resting position. The drop rest assembly includes a tension string connected to the arrow rest for rotating the arrow rest to the arrow resting position, such that release of the tension string allows the arrow rest to move away from the arrow resting position due to the arrow rest being mechanically biased away from the arrow resting position.

19 Claims, 13 Drawing Sheets

DROP REST ASSEMBLY FOR AN ARCHERY BOW

BACKGROUND

The present invention generally relates to archery equipment. More specifically, the present invention relates to arrow rests used with archery bows.

A drop rest for an archery bow supports an arrow shaft prior to firing of the arrow. The drop rest falls away from the arrow shaft as the arrow is released from the archery bow.

It is an object of the present invention to provide an advanced drop rest for an archery bow.

It is another object of the present invention to provide a drop rest with an arrow rest locking system.

SUMMARY OF THE INVENTION

A drop rest assembly, for an archery bow that allows for resting of arrow which is to be fired by the archery bow. The drop rest assembly includes a mounting section adapted to mount to the archery bow. The drop rest assembly includes a drop rest section mounted to the mounting section. The drop rest section includes a drop rest mount which mounts to the mounting section. The drop rest section includes an arrow rest rotatably mounted to the drop rest mount, where the arrow rest mechanically biased away from an arrow resting position. The drop rest assembly includes a tension string connected to the arrow rest for rotating the arrow rest to the arrow resting position, such that release of the tension string allows the arrow rest to move away from the arrow resting position due to the arrow rest being mechanically biased away from the arrow resting position.

DETAILED DESCRIPTION

Figure 1:
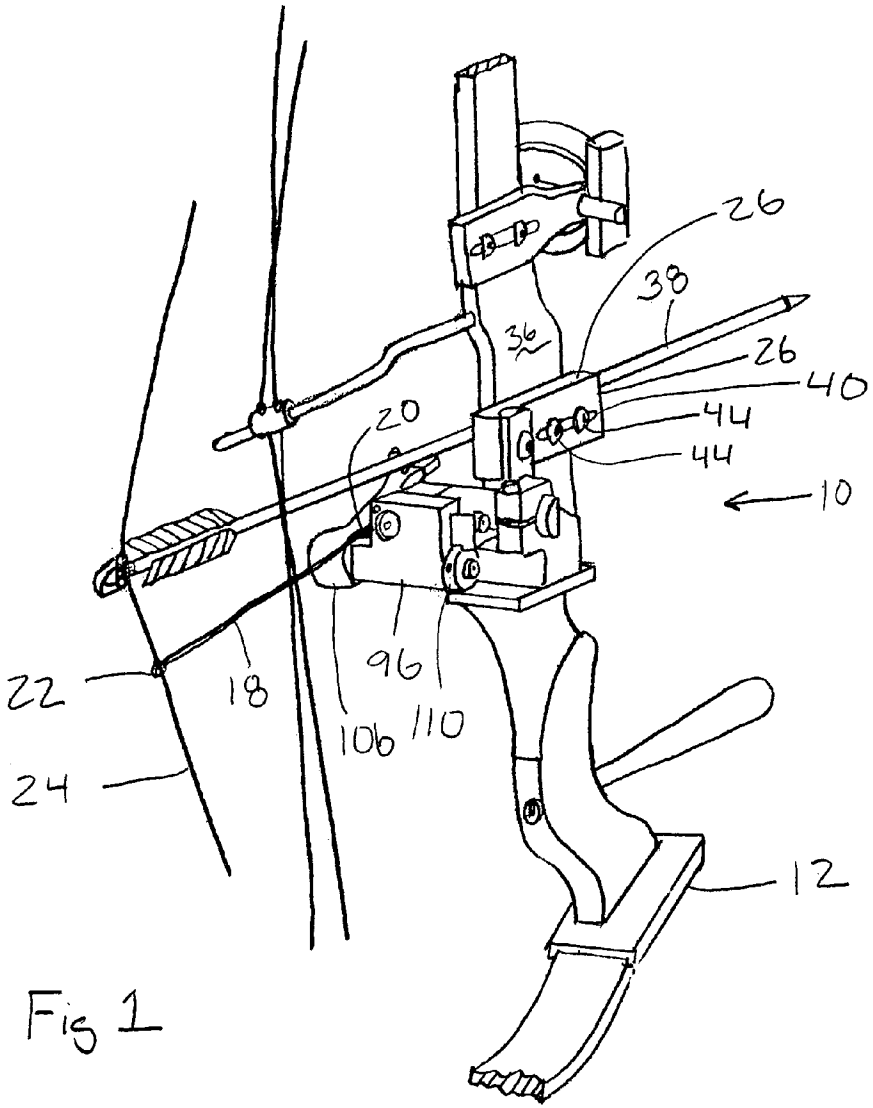
FIG. 1 is a perspective view of a drop rest assembly on an archery bow according to the present invention.
Figure 2:
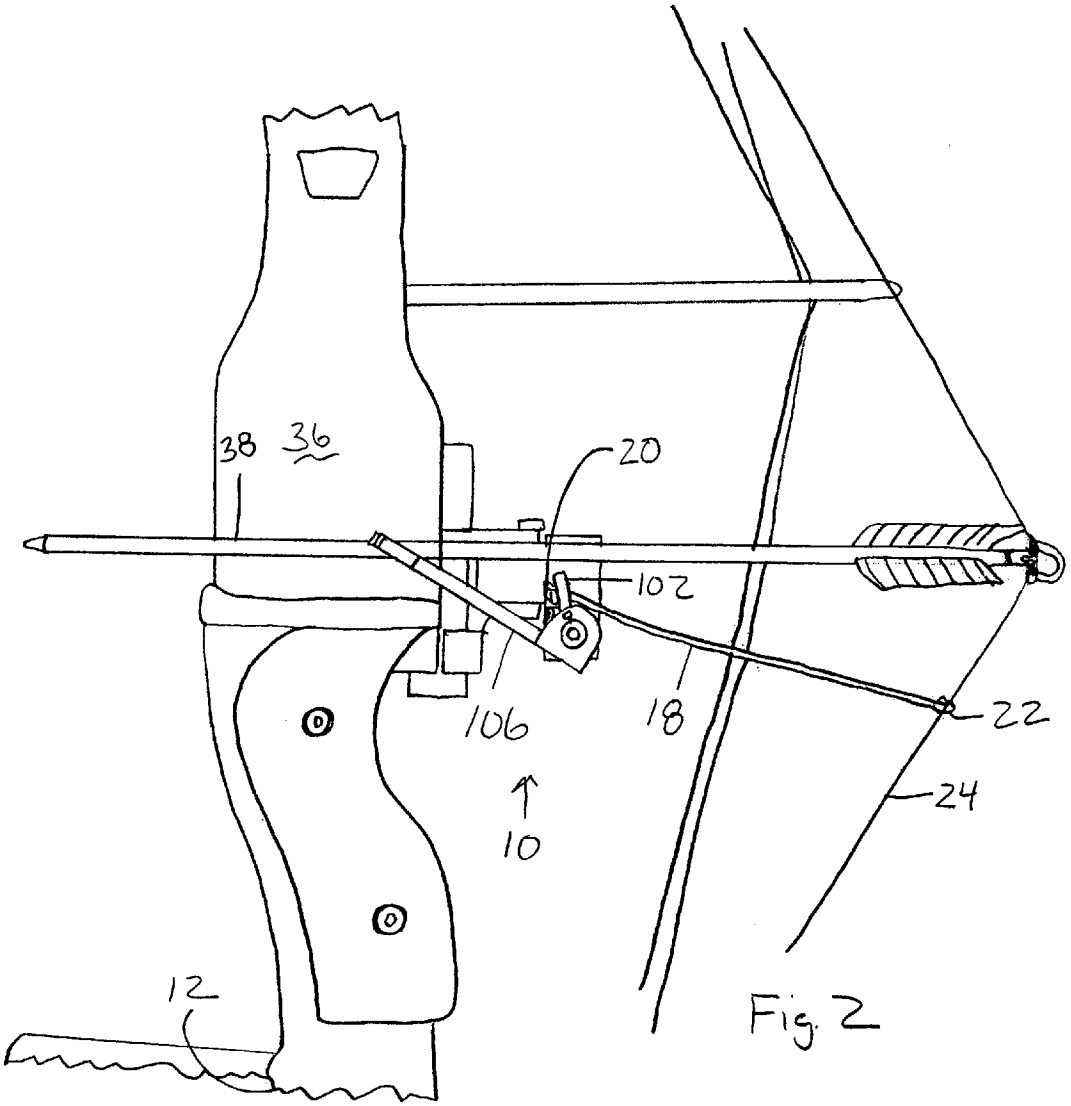
FIG. 2 is a side view of a drop rest assembly on an archery bow according to the present invention.
Figure 3:
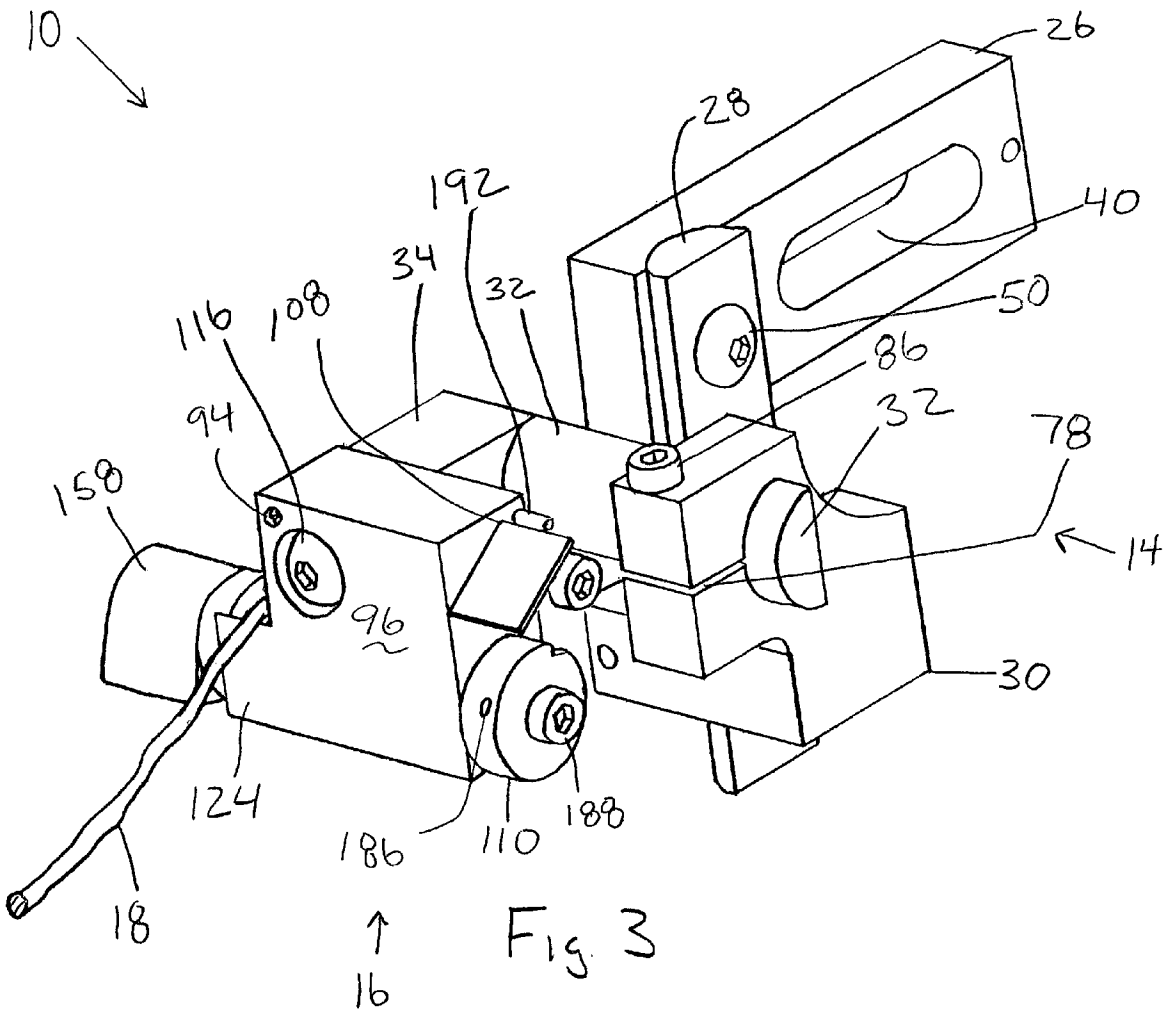
FIG. 3 is a perspective view of a drop rest assembly according to the present invention.
Figure 4:
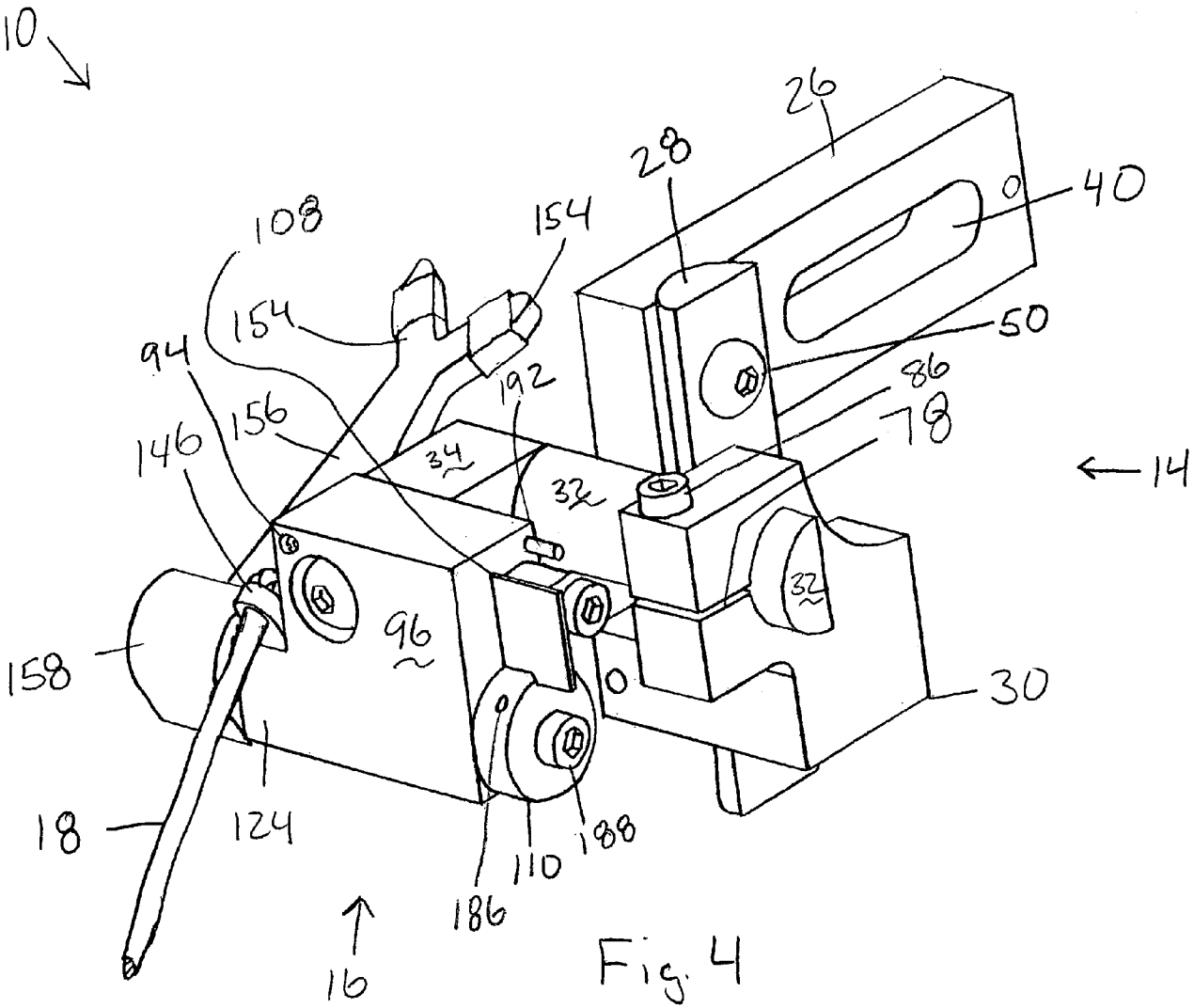
FIG. 4 is a perspective view of a drop rest assembly according to the present invention.
Figure 5:
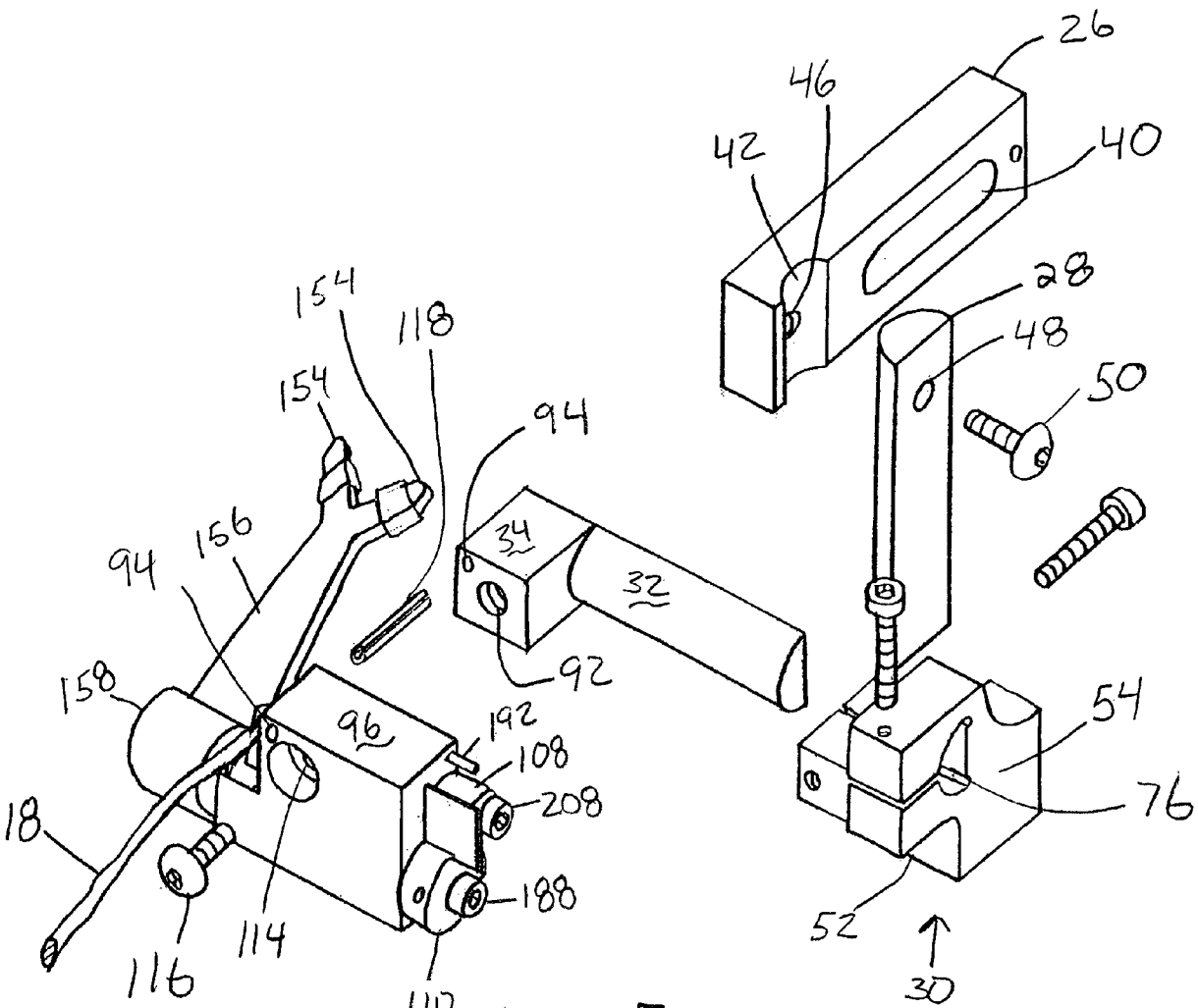
FIG. 5 is an exploded perspective view of a drop rest assembly according to the present invention.
Figure 6:
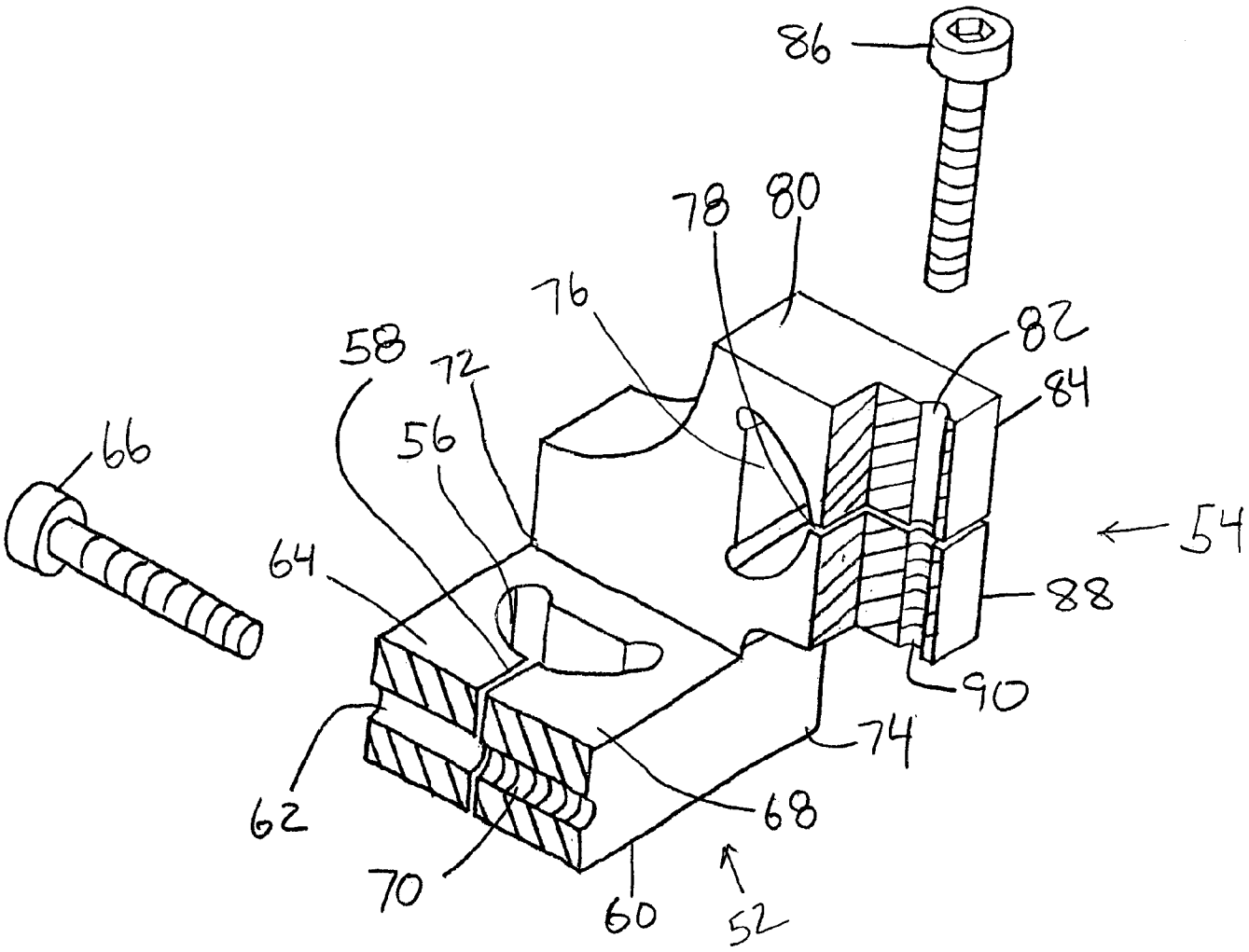
FIG. 6 is a cutaway perspective view of a adjustment slide according to the present invention.

The present invention is a drop rest assembly for an archery bow, as shown in FIGS. 1–13. FIGS. 1–2 show the drop rest assembly 10 mounted to an archery bow 12. FIGS. 3–4 show the drop rest assembly 10. The drop rest assembly 10 includes a mounting section 14, drop rest section 16 and a tension string 18, as shown in FIG. 5. The tension string 18 includes a first end 20 attached to the drop rest section 16 and a second end 22 attached to the drawstring 24 of the archery bow 12, as shown in FIGS. 1–2. The mounting section 14 includes a mounting plate 26, vertical adjustment shaft 28, adjustment slide 30, horizontal adjustment shaft 32 and drop rest section mounting block 34, as shown in FIG. 5. The mounting plate 26 mounts to the riser 36 of the archery bow 12 on the opposite side of where an arrow shaft 38 rests before release, as shown in FIGS. 1–2. The mounting plate 26 includes a mounting hole 40 and a circular shaped groove 42. The mounting hole 40 is used to receive a fastener to fasten the mounting plate 26 to the riser 36 of the archery bow 12. Two fasteners 44 are shown to be used with the mounting plate 26, as shown in FIG. 1. The circular shaped groove 42 includes a threaded screw hole 46 in the mounting plate 26.

The vertical adjustment shaft 28 and horizontal adjustment shaft 32 are both D-shaped shafts. The vertical adjustment shaft 28 includes a screw hole 48 near the top of the vertical adjustment shaft 28. A machine screw 50 is used to mount the vertical adjustment shaft 28 in the circular shaped groove 42 when the threaded screw hole 46 of the circular shaped groove 42 is aligned with the screw hole 48 of the vertical adjustment shaft 28. The adjustment slide 30 includes a horizontal component 52 and a vertical component 54, as show in FIG. 6. The horizontal component 52 includes a D-shaped opening 56 to receive the vertical adjustment shaft 28. The D-shaped opening 56 includes a split 58 which runs from the D-shaped opening 56 to a first end 60 of the horizontal component 52. The first end 60 of the horizontal component 52 includes hole 62 at a first part 64 of the first end 60 of the horizontal component 52 to allow a vertical adjustment screw 66 to pass across the split 58 and onto a second part 68 of the first end 60 of the horizontal component 52. The second part 68 of the first end 60 of the horizontal component 52 includes a threaded hole 70 to receive the vertical adjustment screw 66. The vertical adjustment screw 66 pulls the first part 64 and second part 68 of the first end 60 of the horizontal component 52 together, as the vertical adjustment screw 66 threads into the threaded hole 70 of second part 68 of the first end 60 of the horizontal component 52. The pulling together of the first part 64 and second part 68 of the first end 60 of the horizontal component 52 tightens the D-shaped opening 56 around the vertical adjustment shaft 28 and holds the vertical adjustment shaft 28 in place.

The vertical component 54 of the adjustment slide 30 extends upward from the horizontal component 52. The vertical component 54 includes a second end 72 which is connected to a second end 74 of the horizontal component 52. The vertical component 54 includes a D-shaped opening 76 to receive the horizontal adjustment shaft 32. The D-shaped opening 76 includes a split 78 which runs from the D-shaped opening 76 to a first end 80 of the vertical component 54. The first end 80 of the vertical component 54 includes hole 82 at a first part 84 of the first end 80 of the vertical component 54 to allow a horizontal adjustment screw 86 to pass across the split 78 and onto a second part 88 of the first end 80 of the vertical component 54. The second part 88 of the first end 80 of the vertical component 54 includes a threaded hole 90 to receive the horizontal adjustment screw 86. The horizontal adjustment screw 86 pulls the first part 84 and second part 88 of the first end 80 of the vertical component 54 together, as the horizontal adjustment screw 86 threads into the threaded hole 90 of second part 88 of the first end 80 of the vertical component 54. The pulling together of the first part 84 and second part 88 of the first end 80 of the vertical component 54 tightens the D-shaped opening 76 around the horizontal adjustment shaft 32 and holds the horizontal adjustment shaft 32 in place. The drop rest section mounting block 34 is shown an end of the horizontal adjustment shaft 32. The drop rest section mounting block 34 includes a threaded screw hole 92 and a roll pin hole 94.

The drop rest section 16 includes a drop rest mount 96, cam shaft 98, arrow rest mounting washer 100, string lug 102, arrow rest spring 104, arrow rest 106, cam lock 108, cam 110 and cam lock spring 112. The drop rest mount 96 includes a mounting hole 114 to be aligned with the threaded screw hole 92 of the drop rest section mounting block 34. Mounting screw 116 is used to fasten the drop rest mount 96 to the drop rest section mounting block 34 using the threaded screw hole 92 of the drop rest section mounting block 34 and the mounting hole 114 of the drop rest mount 96. The drop rest mount 96 includes a roll pin hole 94 which aligns with the roll pin hole 94 of the drop rest section mounting block 34. A roll pin 118 is inserted into the roll pin holes 94 of the drop rest section mounting block 34 and the drop rest mount 96 after installing the mounting screw 116 to prevent rotation of the drop rest mount 96.

Figure 7:
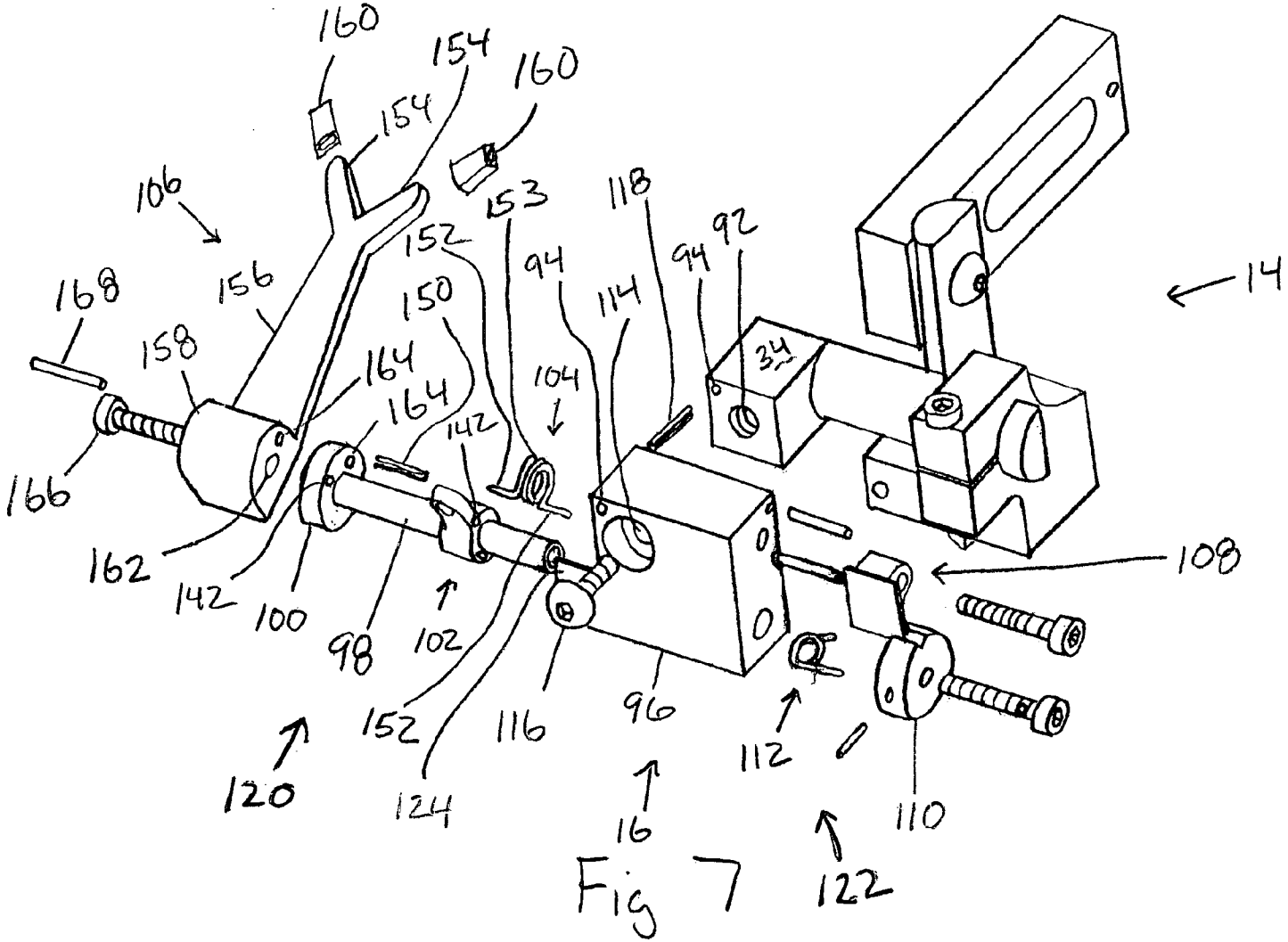
FIG. 7 is an exploded perspective view of a drop rest assembly according to the present invention.
Figure 8:
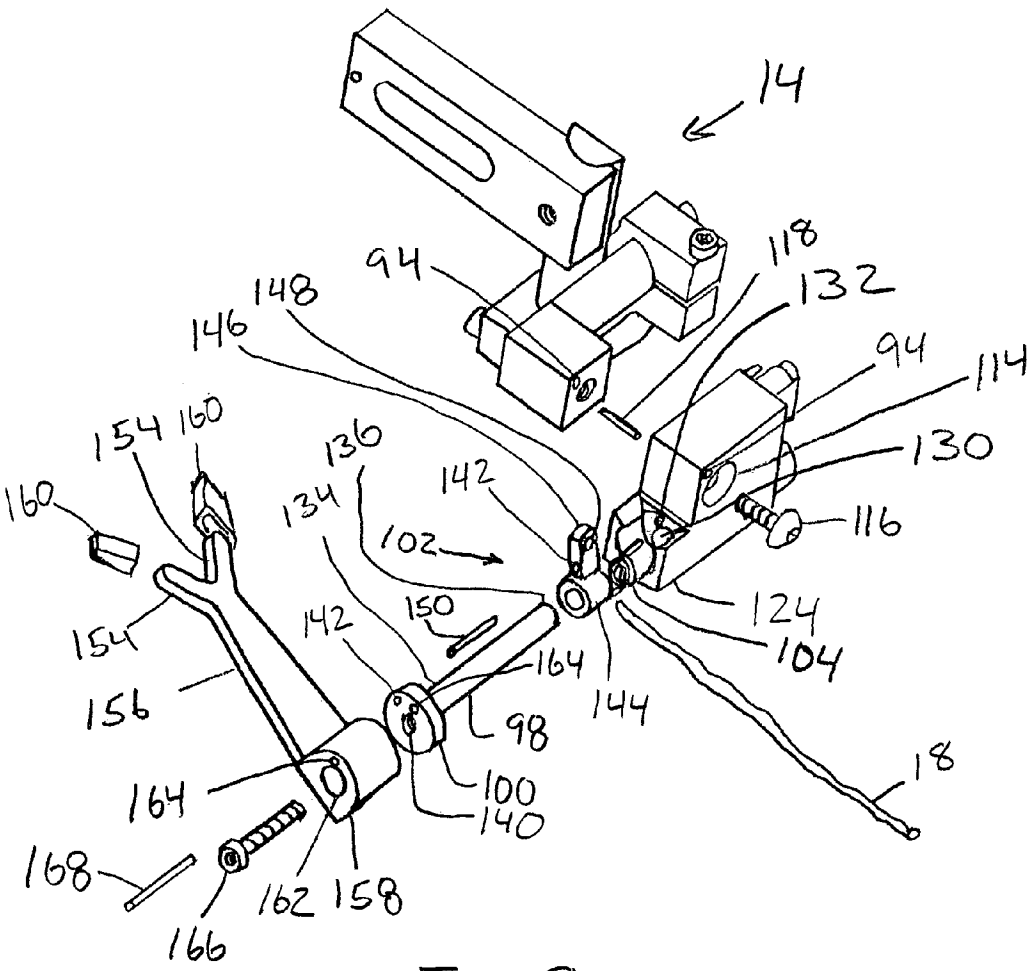
FIG. 8 an exploded perspective view of a drop rest assembly according to the present invention.
Figure 9:
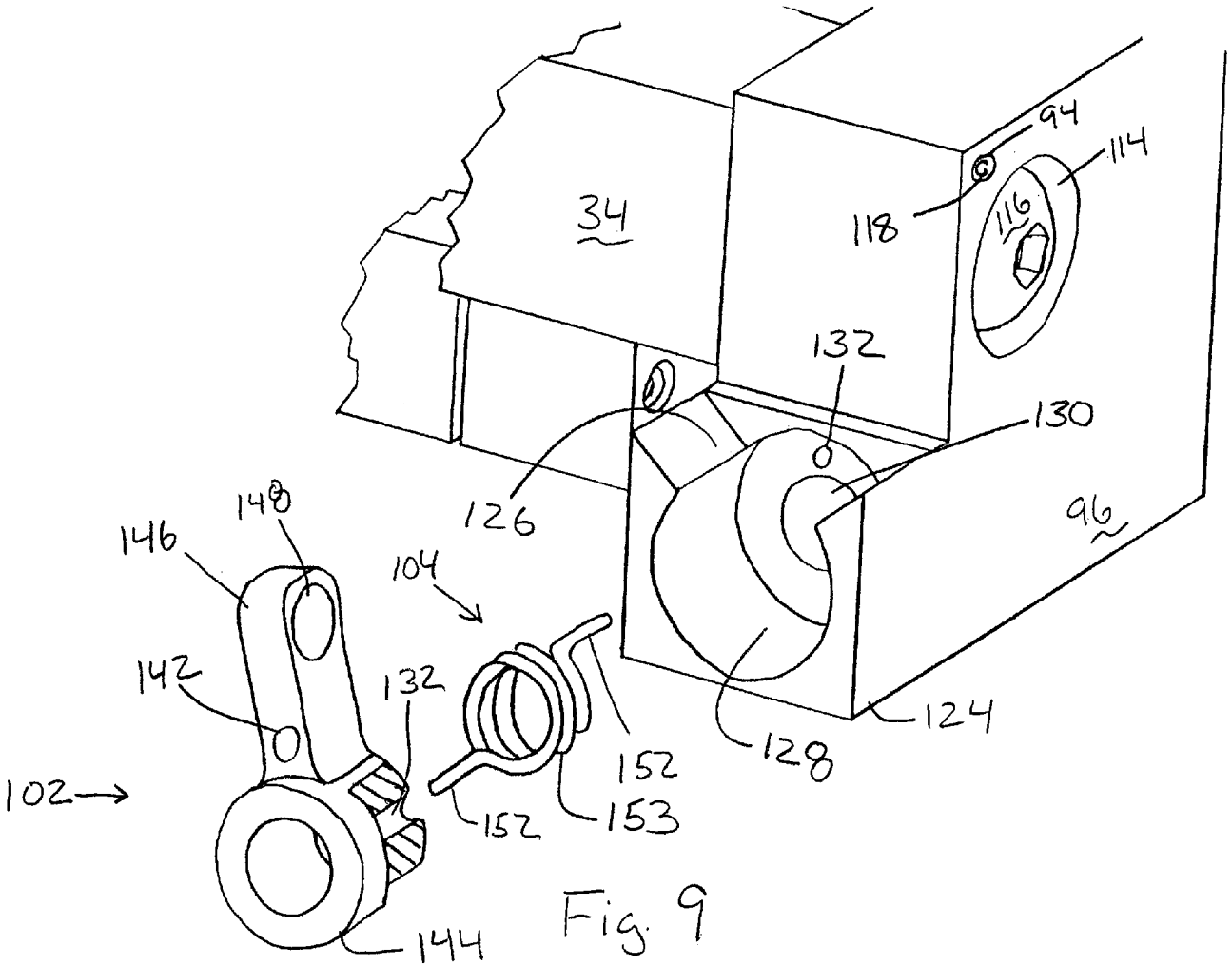
FIG. 9 is an exploded perspective view of a lower extension of a drop rest assembly according to the present invention.
Figure 10:
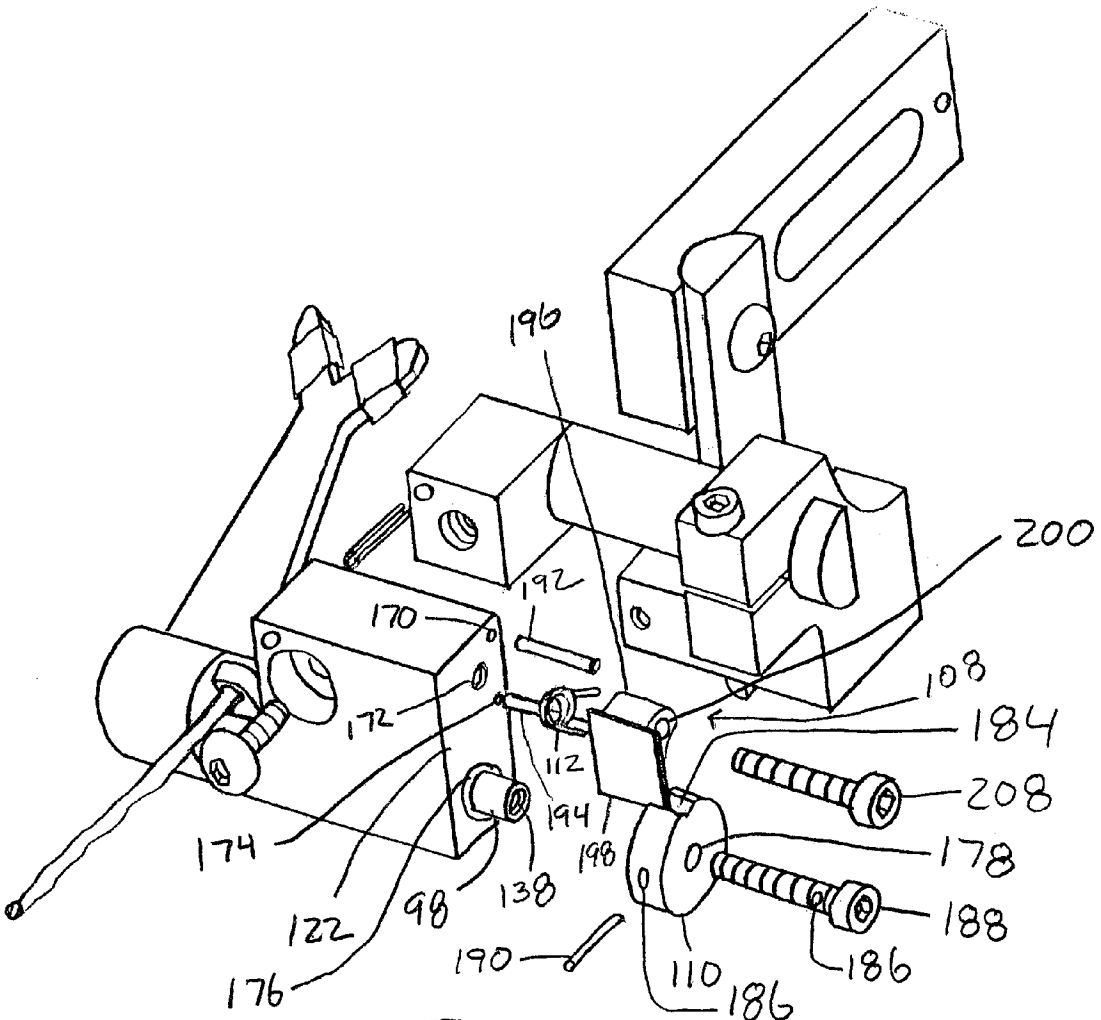
FIG. 10 is an exploded perspective view of a drop rest assembly according to the present invention.
Figure 11:
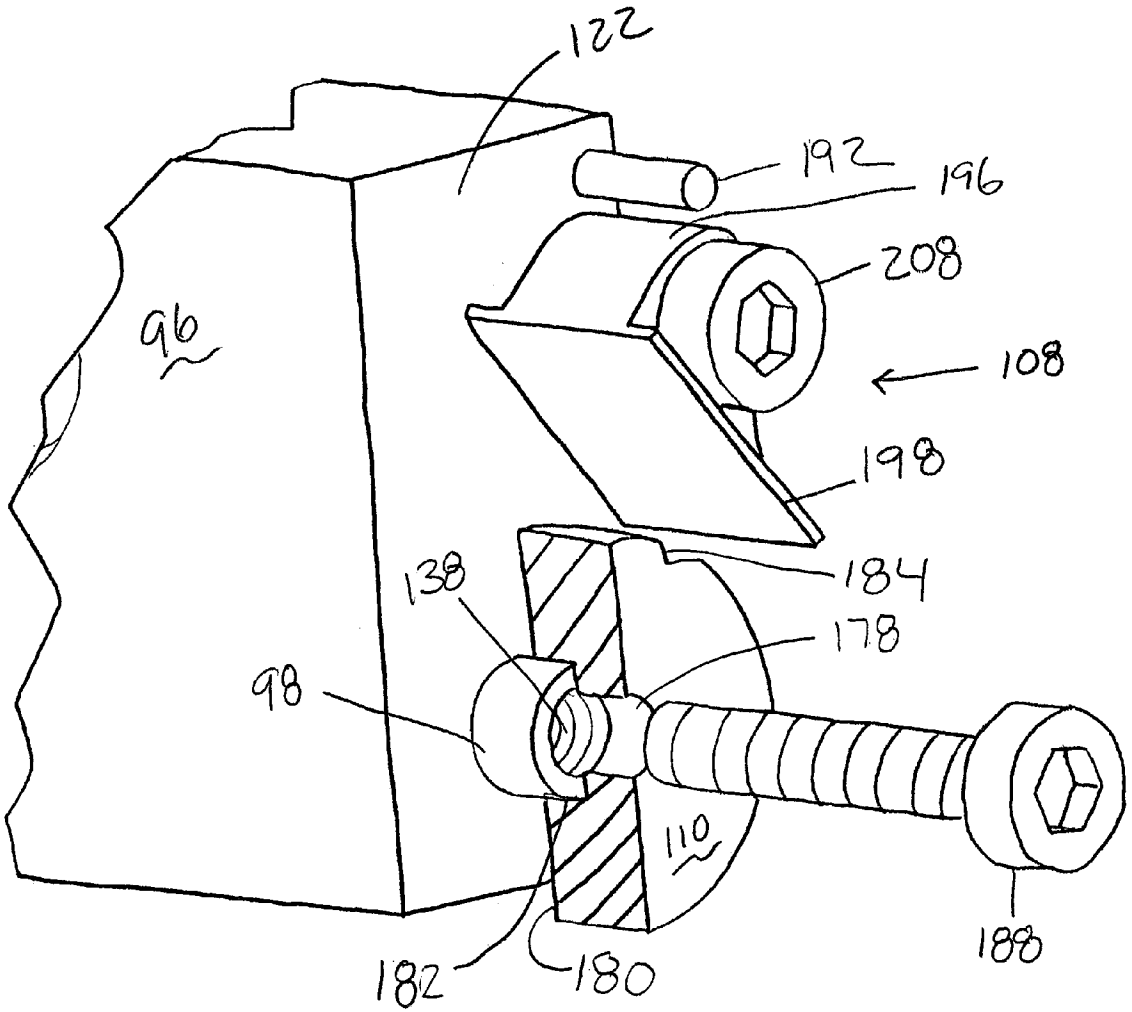
FIG. 11 is a perspective view of a cam side of a drop rest assembly according to the present invention.
Figure 12:
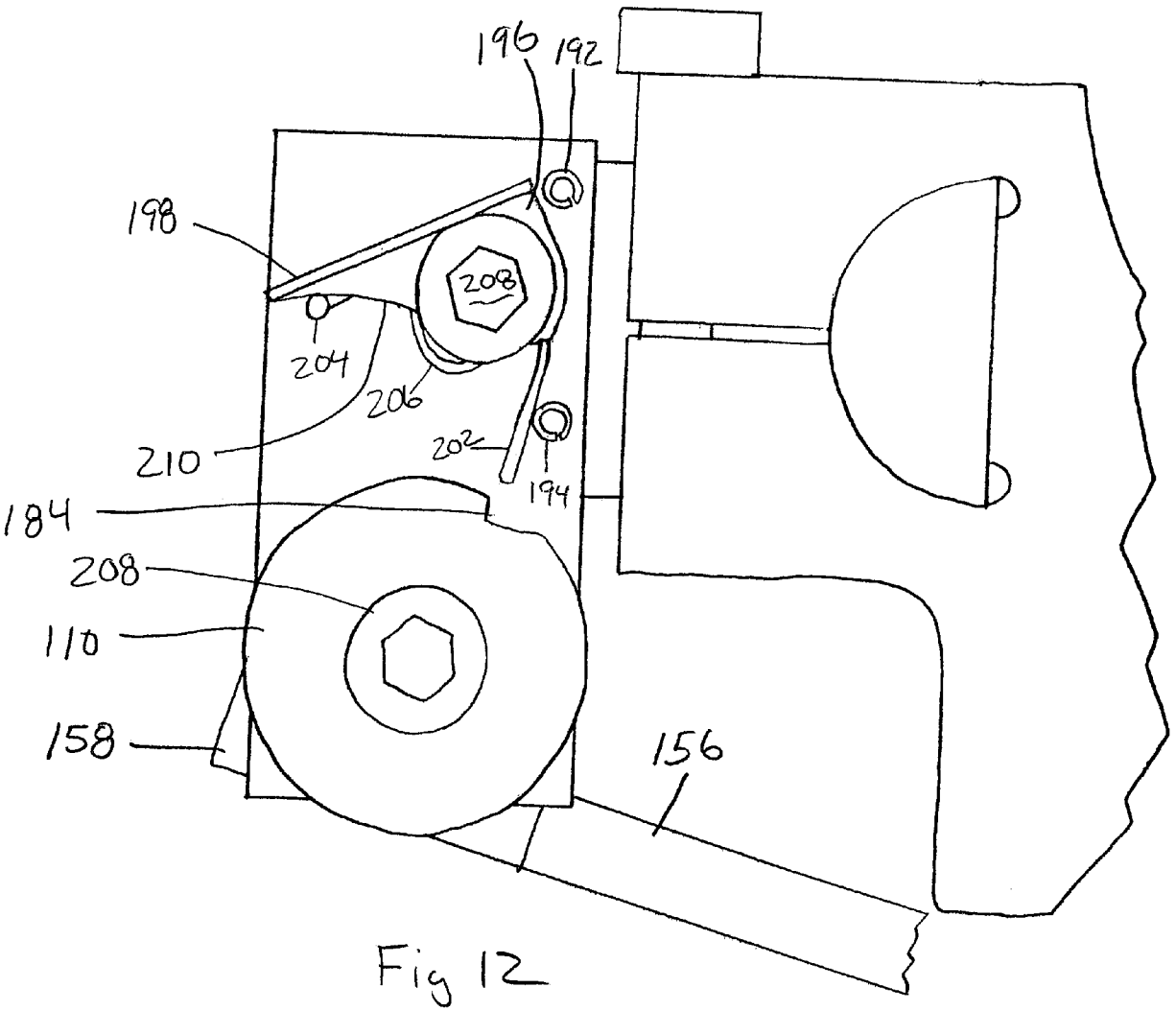
FIG. 12 is a side view of a cam side of a drop rest assembly according to the present invention.

The drop rest mount 96 includes an arrow rest side 120 and a cam side 122, as shown in FIG. 7. The arrow rest side 120 includes a lower extension 124 extending from the arrow rest side 120, as shown in FIGS. 8–9. The lower extension 124 of the arrow rest side 120 forms an open top cavity 126 which has an opening 128 that leads to a shaft through hole 130 in the drop rest mount 96. The shaft through hole 130 exits at the cam side 122. Above the shaft through hole 130 and within the lower extension 124 is a spring leg hole 132. The cam shaft 98 has an arrow rest side 134 and a cam side 136. The cam side 136 of the cam shaft 98 includes a threaded screw hole 138, as shown in FIGS. 10–11. The arrow rest mounting washer 100 is fixed to the arrow rest side 134 of the cam shaft 98. It is suggested to mill the arrow rest mounting washer 100 and the cam shaft 98 from one piece of material. The arrow rest mounting washer 100 includes a threaded screw hole 140 which leads into the cam shaft 98. The arrow rest mounting washer 100 includes a roll pin hole 142. The string lug 102 includes a open cylinder 144 and a lug 146 extending from the open cylinder 144. The open cylinder 144 includes a spring leg hole 132. The lug 146 includes a roll pin hole 142 in one side of the lug 146 and a string attachment hole 148 at the end of the lug 146. The cam side 136 of the cam shaft 98 is inserted into the open cylinder 144 of the string lug 102. A roll pin 150 is used to pin the arrow rest mounting washer 100 and the lug 146 together using the roll pin holes 142 of the arrow rest mounting washer 100 and the lug 146. The roll pin 150 locks the arrow rest mounting washer 100 and the lug 146 together, so that the arrow rest mounting washer 100 and the sting lug 102 rotate together.

The arrow rest spring 104 is a torsion type of coiled spring ending in two legs 152 at ninety degrees to the rotation plane of the coil 153 and facing in opposite directions to each other. The arrow rest spring 104 is inserted into the opening 128 of the lower extension 124. One of the legs 152 of the arrow rest spring 104 is inserted into the spring leg hole 132 of the lower extension 124. The cam shaft 98 is then inserted into the opening 128 of the lower extension 124 and on into the shaft through hole 130 in the drop rest mount 96. The other leg 152 of the of the arrow rest spring 104 is inserted into the spring leg hole 132 of the open cylinder 144 of the string lug 102. The spring leg holes 152 are positioned to load the arrow rest spring 104 such to bias the string lug 102 away from the drawstring 24. The arrow rest 106 includes arrow rest surfaces 154 forming a V-shaped rest, an arm 156 and a connection end 158. Anti-friction sleeves 160 are shown on the arrow rest surfaces 154, as shown in FIGS. 7–8. The connection end 158 includes a screw hole 162 and a roll pin hole 164 which are both through holes. The arrow rest mounting washer 100 also includes an additional roll pin hole 164. The arrow rest 106 is mounted to the arrow rest mounting washer 100 by fastening a screw 166 through the screw hole 162 of the connection end 158 and into the threaded screw hole 140 of the arrow rest mounting washer 100. The connection end 158 and arrow rest mounting washer 100 are pinned together by using a roll pin 168, which is inserted through the roll pin holes 164 of the connection end 158 and arrow rest mounting washer 100. The roll pin 168 locks the connection end 158 and arrow rest mounting washer 100 together, so that they rotate together. Therefore, the connection end 158 and arrow rest mounting washer 100 are biased in a rotational direction away from the drawstring 24, due to the arrow rest mounting washer 100 being interconnected to the string lug 102.

FIGS. 10–13 show different views of the cam side 122 of the drop rest mount 96. The components of the cam side 122 form an arrow rest locking system. The cam side 122 of the drop rest mount 96 includes a cam lock stop roll pin hole 170, threaded screw hole 172, cam lock spring roll pin hole 174 and the exit 176 from the shaft through hole 130. The cam 110 is a circular disc with a screw hole 178 that is a through hole. The inside side 180 of the cam 110 includes an enlarged hole 182 about the screw hole 178 to receive the cam shaft 98, as shown in FIG. 11. The cam 110 includes a latch groove 184 along the circumference of the disc. The cam 110 also includes a roll pin hole 186 starting at outside circumference and leading to the screw hole 178. The cam 110 is mounted to the cam side 136 of the cam shaft 98, which sticks out from the exit 176 of the shaft through hole 130. A screw 188 is inserted into the screw hole 178 of the cam 110 and threaded into the threaded screw hole 138 of the cam side 136 of the cam shaft 98. After assembly of the cam 110 to the cam shaft 98, a roll pin hole 186 is drilled into the screw 188 via the roll pin hole 186 of the cam 110. Then, a roll pin 190 is inserted into the roll pin hole 186 of the cam 110 and into the roll pin hole 186 of the screw 188.

A cam lock stop roll pin 192 is inserted into the cam lock stop roll pin hole 170 so that it extends out from the cam side 122 of the drop rest mount 96. A cam lock spring roll pin 194 is inserted in to the cam lock spring roll pin hole 174 so that it extends out from the cam side 122 of the drop rest mount 96. The cam lock 108 includes a connecting body 196 and a latch 198 extending from the connecting body 196. The connecting body 196 includes a screw hole 200. The cam lock spring 112 is a torsion type of coiled spring with a straight leg 202 and bent leg 204. The bent leg 204 is ninety degrees to the coil 206 of the cam lock spring 112. A screw 208 is inserted into the screw hole 200 of the connecting body 196 and through the coil 206 of the cam lock spring 112. The screw 208 is then threaded into the threaded screw hole 172 of the cam side 122 of the drop rest mount 96. The cam lock spring 112 is positioned such that the bent leg 204 contacts and is tensioned against an inside surface 210 of the cam lock 108 between the connecting body 196 and the latch 198. The cam lock spring 112 is also positioned such that the straight leg 202 contacts and is tensioned against the cam lock spring roll pin 194. The latch 198 of the cam lock 108 is tensioned away from the cam 110 by the cam lock spring 112, but can be rotated toward the cam 110 under force. The cam lock stop roll pin 192 interacts with the connecting body 196 of the cam lock 108 and prevents rotation of the latch 198 to far away from the cam 110 and aids in retaining the tension relationship between the cam lock spring 112 and the cam lock 108.

Figure 13:
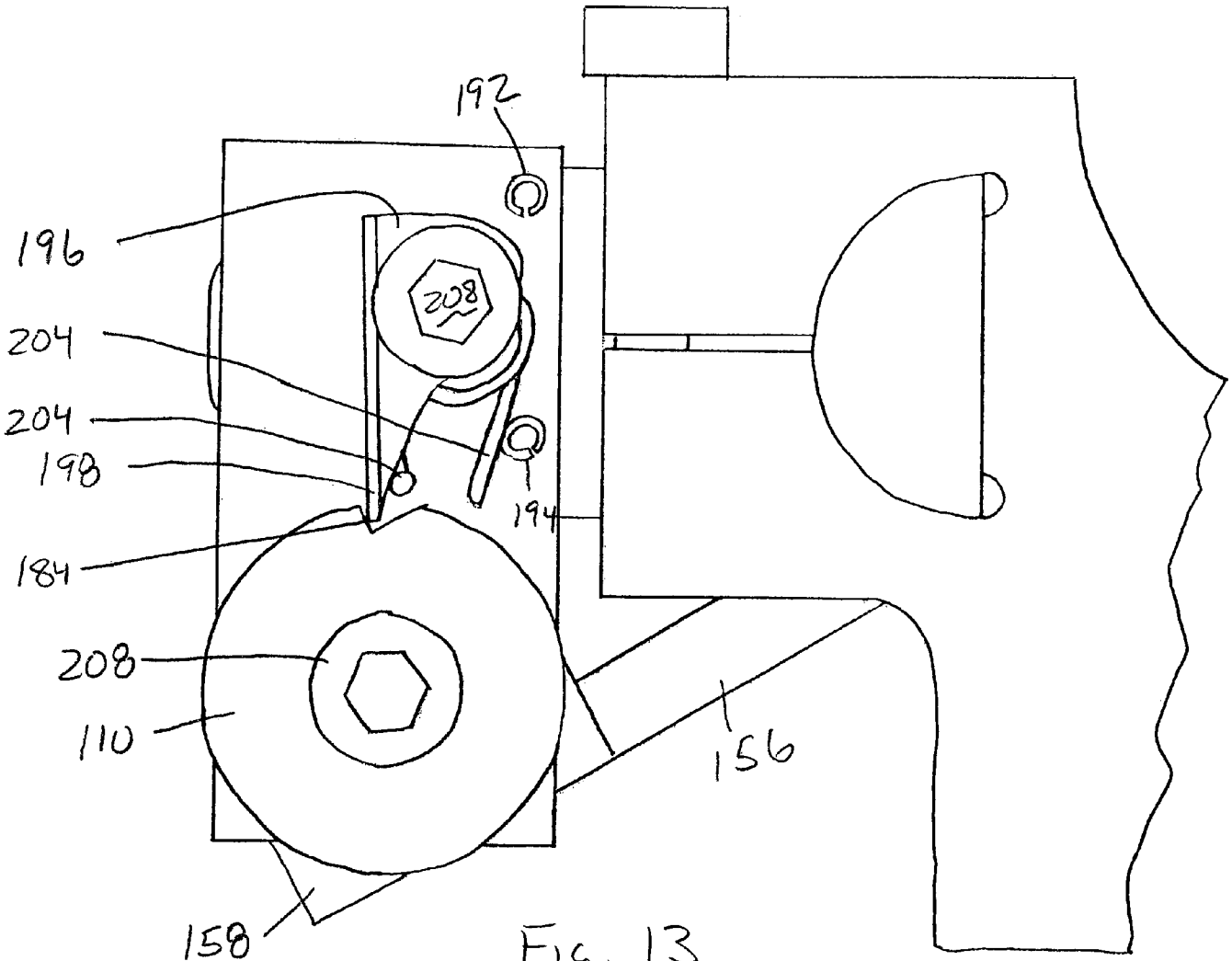
FIG. 13 is a side view of a cam side of a drop rest assembly according to the present invention.

FIGS. 1–2 show the arrow rest 106 in an arrow support pre-rest position. An arrow shaft 38 is supported by the arrow rest surfaces 154 of the arrow rest 106. The arrow rest 106 is retained in the arrow support pre-rest position by the arrow rest locking system. The arrow rest spring 104 biases the arrow rest 106 away from the arrow shaft 38 and therefore the arrow rest locking system is used to retain the arrow rest 106 in the arrow support pre-rest position. Pulling back on the arrow rest 106 by pulling the tension string 18, which pulls the lug 146 and rotates the arrow rest 106, allows the user to move the latch 198 to engage the latch groove 184 of the cam 110, as shown in FIGS. 4 and 13. The arrow rest 106 is locked into the arrow support pre-rest position, when the latch 198 is engaged with the latch groove 184 of the cam 110. The arrow shaft 38 can be placed onto the arrow rest surfaces 154 of the arrow rest 106. When the user pulls on the drawstring 24 of the archery bow 12, the tension string 18 pulls on and rotates the lug 146. The rotation of the lug 146 caused the arrow rest 106 to rotate back further to an arrow resting position. The arrow resting position is the desired position of the arrow rest 106 prior to firing of the arrow. The rotation of the lug 146 also causes rotation of the cam shaft 98, which in turn rotates the cam 110. This rotation of the cam 110 causes the latch 198 to disengage from the latch groove 184 and move away from the cam 110 due to the cam lock spring 112 biasing the latch 198 away from the cam 110. When the user releases the drawstring 24, the tension on the tension string 18 is released and the arrow rest surfaces 154 of the arrow rest 106 move forward and downward due to forced rotation of the connection end 158. The connection end 158 is forced to rotate due to the arrow rest spring 104 causing the string lug 102 to rotate. Whereby, rotation of the string lug 102 causes the arrow rest washer 100 and the connection end 158 to rotate due to the interconnection with the string lug 102, arrow rest washer 100 and the connection end 158. The arrow rest 106 can also be pulled to the arrow resting position without the use of the arrow rest locking system, simply by pulling back on the drawstring 24, which in turn pulls on the tension string 18 and rotates the arrow rest surfaces 154 of the arrow rest up and back. One of the advantages of the present invention is that the arrow rest surfaces 154 move away from the arrow shaft 38 faster. The arrow rest surfaces 154 move away from the arrow shaft 38 faster, because the rotation point of the connection end 158 is at the lower extension, which is the lowest point on the drop rest assembly 10 in relation to arrow resting position. Units currently on the market have a higher rotation point.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A drop rest assembly, for an archery bow that allows for resting of arrow which is to be fired by the archery bow, comprising:

a mounting section which is adapted to mount to the archery bow; and a drop rest section mounted to said mounting section, said drop rest section comprising:

a drop rest mount which mounts to said mounting section;

an arrow rest rotatably mounted to said drop rest mount, said arrow rest mechanically biased away from an arrow resting position; and a tension string connected to said arrow rest for rotating said arrow rest to said arrow resting position, such that release of said tension string allows said arrow rest to move away from said arrow resting position due to said arrow rest being mechanically biased away from said arrow resting position;

wherein said mounting section comprises:

a mounting plate adapted to mount to the archery bow, said mounting plate including a mounting hole and a circular shaped groove, said circular shaped groove including a threaded screw hole in said mounting plate;

a vertical adjustment shaft having a D-shape, said vertical adjustment shaft including screw hole near a top of said vertical adjustment shaft for mounting said vertical adjustment shaft to said circular shaped groove at said threaded screw hole in said circular shaped groove;

a horizontal adjustment shaft having a D-shape;

a drop rest section mounting block attached to one end of said horizontal adjustment shaft, said drop rest section mounting block including a threaded screw hole to allow attachment of said drop rest section; and an adjustment slide, said adjustment slide including a horizontal component and a vertical component, said horizontal component includes a split D-shaped opening to receive said vertical adjustment shaft, further including a fastener to tighten said split D-shaped opening of said horizontal component about said vertical adjustment shaft, said vertical component includes a split D-shaped opening to receive said horizontal adjustment shaft, further including a fastener to tighten said split D-shaped opening of said vertical component about said horizontal adjustment shaft.

2. The drop rest assembly of claim 1, wherein a rotation point of said arrow rest is at a lowest point on said arrow rest mount to promote a faster drop away from said arrow resting position.

3. A drop rest assembly, for an archery bow that allows for resting of arrow which is to be fired by the archery bow, comprising:

a mounting section which is adapted to mount to the archery bow; and a drop rest section mounted to said mounting section, said drop rest section comprising:

a drop rest mount which mounts to said mounting section;

an arrow rest rotatably mounted to said drop rest mount, said arrow rest mechanically biased away from an arrow resting position; and a tension string connected to said arrow rest for rotating said arrow rest to said arrow resting position, such that release of said tension string allows said arrow rest to move away from said arrow resting position due to said arrow rest being mechanically biased away from said arrow resting position;

wherein said drop rest section includes an arrow rest locking system which locks said arrow rest in an arrow support pre-rest position, said arrow rest locking system interacting with said arrow rest such that said arrow rest locking system disengages from said arrow rest when said tension sting is pulled and rotates said arrow rest to said arrow resting position.

4. The drop rest assembly of claim 3, wherein said arrow rest locking system includes a cam, cam lock and cam lock spring; wherein said cam is connected to said arrow rest such that said arrow rest and said cam move as one; wherein said cam includes a latch groove; wherein said cam lock rotatably attaches to said drop rest mount; wherein said cam lock includes a latch to engage said latch groove of said cam and locks said cam and said arrow rest in place; and wherein said cam lock and said cam lock spring interconnect such that said latch of said cam lock is biased away from said latch groove of said cam.

5. The drop rest assembly of claim 4, wherein said arrow rest and said cam are connected together by a cam shaft.

6. The drop rest assembly of claim 4, wherein said drop rest mount includes an arrow rest side; wherein said arrow rest side includes a lower extension extending from said arrow rest side; wherein said lower extension of said arrow rest side forms an open top cavity and includes an opening that leads to a shaft through hole in said drop rest mount; wherein about said shaft through hole and within said lower extension is a spring leg hole; further including a cam shaft having an arrow rest side and a cam side, said cam side rotatably inserted into said shaft through hole; further including an arrow rest mounting washer fixed to said arrow rest side of said cam shaft; wherein said arrow rest is fixed to said arrow rest mounting washer; further including a string lug fixed to said arrow rest mounting washer, said string lug extending out of said open top cavity with a string attachment hole at an end of said string lug for attachment of said tension string, said string lug including a spring leg hole; further including an arrow rest spring attached between said spring leg hole of said string lug and said spring leg hole of said lower extension to bias said arrow rest from said arrow resting position; and wherein said cam shaft, said string lug and said arrow rest are interconnected such that said cam shaft, said string lug and said arrow rest rotate together as one.

7. The drop rest assembly of claim 6, wherein said arrow rest includes arrow rest surfaces forming a V-shaped rest, a connection end connected to said arrow rest mounting washer and an arm extending from said connection end and connected to said V-shaped rest.

8. The drop rest assembly of claim 7, wherein said mounting section comprises:

a mounting plate adapted to mount to the archery bow, said mounting plate including a mounting hole and a circular shaped groove, said circular shaped groove including a threaded screw hole in said mounting plate;

a vertical adjustment shaft having a D-shape, said vertical adjustment shaft including screw hole near a top of said vertical adjustment shaft for mounting said vertical adjustment shaft to said circular shaped groove at said threaded screw hole in said circular shaped groove;

a horizontal adjustment shaft having a D-shape;

a drop rest section mounting block attached to one end of said horizontal adjustment shaft, said drop rest section mounting block including a threaded screw hole to allow attachment of said drop rest section; and an adjustment slide, said adjustment slide including a horizontal component and a vertical component, said horizontal component includes a split D-shaped opening to receive said vertical adjustment shaft, further including a fastener to tighten said split D-shaped opening of said horizontal component about said vertical adjustment shaft, said vertical component includes a split D-shaped opening to receive said horizontal adjustment shaft, further including a fastener to tighten said split D-shaped opening of said vertical component about said horizontal adjustment shaft.

9. The drop rest assembly of claim 4, wherein said mounting section comprises:

a mounting plate adapted to mount to the archery bow, said mounting plate including a mounting hole and a circular shaped groove, said circular shaped groove including a threaded screw hole in said mounting plate;

a vertical adjustment shaft having a D-shape, said vertical adjustment shaft including screw hole near a top of said vertical adjustment shaft for mounting said vertical adjustment shaft to said circular shaped groove at said threaded screw hole in said circular shaped groove;

a horizontal adjustment shaft having a D-shape;

a drop rest section mounting block attached to one end of said horizontal adjustment shaft, said drop rest section mounting block including a threaded screw hole to allow attachment of said drop rest section; and an adjustment slide, said adjustment slide including a horizontal component and a vertical component, said horizontal component includes a split D-shaped opening to receive said vertical adjustment shaft, further including a fastener to tighten said split D-shaped opening of said horizontal component about said vertical adjustment shaft, said vertical component includes a split D-shaped opening to receive said horizontal adjustment shaft, further including a fastener to tighten said split D-shaped opening of said vertical component about said horizontal adjustment shaft.

10. The drop rest assembly of claim 3, wherein said drop rest mount includes an arrow rest side; wherein said arrow rest side includes a lower extension extending from said arrow rest side; wherein said lower extension of said arrow rest side forms an open top cavity and includes an opening that leads to a shaft through hole in said drop rest mount; wherein about said shaft through hole and within said lower extension is a spring leg hole; further including a cam shaft having an arrow rest side and a cam side, said cam side rotatably inserted into said shaft through hole; further including an arrow rest mounting washer fixed to said arrow rest side of said cam shaft; wherein said arrow rest is fixed to said arrow rest mounting washer; further including a string lug fixed to said arrow rest mounting washer, said string lug extending out of said open top cavity with a string attachment hole at an end of said string lug for attachment of said tension string, said string lug including a spring leg hole; further including an arrow rest spring attached between said spring leg hole of said string lug and said spring leg hole of said lower extension to bias said arrow rest from said arrow resting position; and wherein said cam shaft, said string lug and said arrow rest are interconnected such that said cam shaft, said string lug and said arrow rest rotate together as one.

11. The drop rest assembly of claim 10, wherein said arrow rest includes arrow rest surfaces forming a V-shaped rest, a connection end connected to said arrow rest mounting washer and an arm extending from said connection end and connected to said V-shaped rest.

12. The drop rest assembly of claim 11, wherein said mounting section comprises:

a mounting plate adapted to mount to the archery bow, said mounting plate including a mounting hole and a circular shaped groove, said circular shaped groove including a threaded screw hole in said mounting plate;

a vertical adjustment shaft having a D-shape, said vertical adjustment shaft including screw hole near a top of said vertical adjustment shaft for mounting said vertical adjustment shaft to said circular shaped groove at said threaded screw hole in said circular shaped groove;

a horizontal adjustment shaft having a D-shape;

a drop rest section mounting block attached to one end of said horizontal adjustment shaft, said drop rest section mounting block including a threaded screw hole to allow attachment of said drop rest section; and an adjustment slide, said adjustment slide including a horizontal component and a vertical component, said horizontal component includes a split D-shaped opening to receive said vertical adjustment shaft, further including a fastener to tighten said split D-shaped opening of said horizontal component about said vertical adjustment shaft, said vertical component includes a split D-shaped opening to receive said horizontal adjustment shaft, further including a fastener to tighten said split D-shaped opening of said vertical component about said horizontal adjustment shaft.

13. The drop rest assembly of claim 10, wherein said mounting section comprises:

a mounting plate adapted to mount to the archery bow, said mounting plate including a mounting hole and a circular shaped groove, said circular shaped groove including a threaded screw hole in said mounting plate;

a vertical adjustment shaft having a D-shape, said vertical adjustment shaft including screw hole near a top of said vertical adjustment shaft for mounting said vertical adjustment shaft to said circular shaped groove at said threaded screw hole in said circular shaped groove;

a horizontal adjustment shaft having a D-shape;

a drop rest section mounting block attached to one end of said horizontal adjustment shaft, said drop rest section mounting block including a threaded screw hole to allow attachment of said drop rest section; and an adjustment slide, said adjustment slide including a horizontal component and a vertical component, said horizontal component includes a split D-shaped opening to receive said vertical adjustment shaft, further including a fastener to tighten said split D-shaped opening of said horizontal component about said vertical adjustment shaft, said vertical component includes a split D-shaped opening to receive said horizontal adjustment shaft, further including a fastener to tighten said split D-shaped opening of said vertical component about said horizontal adjustment shaft.

14. The drop rest assembly of claim 3, wherein said mounting section comprises:

a mounting plate adapted to mount to the archery bow, said mounting plate including a mounting hole and a circular shaped groove, said circular shaped groove including a threaded screw hole in said mounting plate;

a vertical adjustment shaft having a D-shape, said vertical adjustment shaft including screw hole near a top of said vertical adjustment shaft for mounting said vertical adjustment shaft to said circular shaped groove at said threaded screw hole in said circular shaped groove;

a horizontal adjustment shaft having a D-shape;

a drop rest section mounting block attached to one end of said horizontal adjustment shaft, said drop rest section mounting block including a threaded screw hole to allow attachment of said drop rest section; and an adjustment slide, said adjustment slide including a horizontal component and a vertical component, said horizontal component includes a split D-shaped opening to receive said vertical adjustment shaft, further including a fastener to tighten said split D-shaped opening of said horizontal component about said vertical adjustment shaft, said vertical component includes a split D-shaped opening to receive said horizontal adjustment shaft, further including a fastener to tighten said split D-shaped opening of said vertical component about said horizontal adjustment shaft.

15. A drop rest assembly, for an archery bow that allows for resting of arrow which is to be fired by the archery bow, comprising:

a mounting section which is adapted to mount to the archery bow; and a drop rest section mounted to said mounting section, said drop rest section comprising:

a drop rest mount which mounts to said mounting section;

an arrow rest rotatably mounted to said drop rest mount, said arrow rest mechanically biased away from an arrow resting position; and a tension string connected to said arrow rest for rotating said arrow rest to said arrow resting position, such that release of said tension string allows said arrow rest to move away from said arrow resting position due to said arrow rest being mechanically biased away from said arrow resting position;

wherein said drop rest mount includes an arrow rest side; wherein said arrow rest side includes a lower extension extending from said arrow rest side; wherein said lower extension of said arrow rest side forms an open top cavity and includes an opening that leads to a shaft through hole in said drop rest mount; wherein about said shaft through hole and within said lower extension is a spring leg hole; further including a cam shaft having an arrow rest side and a cam side, said cam side rotatably inserted into said shaft through hole; further including an arrow rest mounting washer fixed to said arrow rest side of said cam shaft; wherein said arrow rest is fixed to said arrow rest mounting washer; further including a string lug fixed to said arrow rest mounting washer, said string lug extending out of said open top cavity with a string attachment hole at an end of said string lug for attachment of said tension string, said string lug including a spring leg hole; further including an arrow rest spring attached between said spring leg hole of said string lug and said spring leg hole of said lower extension to bias said arrow rest from said arrow resting position; and wherein said cam shaft, said string lug and said arrow rest are interconnected such that said cam shaft, said string lug and said arrow rest rotate together as one.

16. The drop rest assembly of claim 15, wherein said arrow rest includes arrow rest surfaces forming a V-shaped rest, a connection end connected to said arrow rest mounting washer and an arm extending from said connection end and connected to said V-shaped rest.

17. The drop rest assembly of claim 16, wherein said drop rest section includes an arrow rest locking system which locks said arrow rest in an arrow support pre-rest position, said arrow rest locking system interacting with said arrow rest such that said arrow rest locking system disengages from said arrow rest when said tension sting is pulled and rotates said arrow rest to said arrow rest position.

18. The drop rest assembly of claim 15, wherein said mounting section comprises:

a mounting plate adapted to mount to the archery bow, said mounting plate including a mounting hole and a circular shaped groove, said circular shaped groove including a threaded screw hole in said mounting plate;

a vertical adjustment shaft having a D-shape, said vertical adjustment shaft including screw hole near a top of said vertical adjustment shaft for mounting said vertical adjustment shaft to said circular shaped groove at said threaded screw hole in said circular shaped groove;

a horizontal adjustment shaft having a D-shape;

a drop rest section mounting block attached to one end of said horizontal adjustment shaft, said drop rest section mounting block including a threaded screw hole to allow attachment of said drop rest section; and an adjustment slide, said adjustment slide including a horizontal component and a vertical component, said horizontal component includes a split D-shaped opening to receive said vertical adjustment shaft, further including a fastener to tighten said split D-shaped opening of said horizontal component about said vertical adjustment shaft, said vertical component includes a split D-shaped opening to receive said horizontal adjustment shaft, further including a fastener to tighten said split D-shaped opening of said vertical component about said horizontal adjustment shaft.

19. The drop rest assembly of claim 15, wherein said drop rest section includes an arrow rest locking system which locks said arrow rest in an arrow support pre-rest position, said arrow rest locking system interacting with said arrow rest such that said arrow rest locking system disengages from said arrow rest when said tension sting is pulled and rotates said arrow rest to said arrow rest position.

* * * * *